United States Patent [19]

Vause

[11] Patent Number: 4,824,406

[45] Date of Patent: Apr. 25, 1989

[54] ELECTRICAL CONNECTORS

[76] Inventor: Francis Vause, Vine House Farm, Whinney Lane, Mellor, Blackburn, Lancashire, England

[21] Appl. No.: 788,512

[22] Filed: Oct. 18, 1985

Related U.S. Application Data

[63] Continuation-in-part of Ser. No. 444,890, Nov. 12, 1982, abandoned.

[30] Foreign Application Priority Data

Mar. 13, 1981 [GB] United Kingdom ..... 8108030

[51] Int. Cl.[4] ..... H01R 4/50

[52] U.S. Cl. ..... 439/864

[58] Field of Search ..... 439/387, 773, 863, 864

[56] References Cited

U.S. PATENT DOCUMENTS

| | | | |
|---|---|---|---|
| 1,984,016 | 12/1934 | Gisske . | |
| 3,017,678 | 1/1962 | Christensen | 24/134 R |
| 3,999,829 | 12/1976 | Glaesel | 339/274 |

FOREIGN PATENT DOCUMENTS

| | | | |
|---|---|---|---|
| 476897 | 5/1929 | Fed. Rep. of Germany . | |
| 2515842 | 10/1976 | Fed. Rep. of Germany | 339/95 D |
| 1463164 | 12/1966 | France . | |
| 243210 | 12/1946 | Switzerland . | |
| 273217 | 1/1951 | Switzerland . | |
| 0564675 | 7/1977 | U.S.S.R. | 339/75 M |
| 658906 | 10/1951 | United Kingdom . | |
| 758921 | 10/1956 | United Kingdom . | |
| 784003 | 10/1957 | United Kingdom . | |
| 1076687 | 11/1965 | United Kingdom . | |
| 1161017 | 8/1969 | United Kingdom . | |
| 1209925 | 10/1970 | United Kingdom . | |
| 1321112 | 6/1973 | United Kingdom . | |
| 1449025 | 9/1976 | United Kingdom . | |
| 2028016 | 2/1980 | United Kingdom . | |
| 2042285 | 9/1980 | United Kingdom . | |

*Primary Examiner*—Gary F. Paumen

*Attorney, Agent, or Firm*—Max L. Wymore

[57] ABSTRACT

An electrical connector for a multi-pin electric plug comprises a first member (1) having a leg (2) and a U-shaped recess (3) in which a second member (5) engages to grip an electrical conductor therebetween. The second member (5) is pivotally mounted on the first member (1), such that, upon attempted withdrawal of the conductor, the two members (1, 5) are urged together to grip the conductor more firmly therebetween. The connector is shown in the closed position. In order to connect an electrical conductor, the second member (5) is pivoted upwardly and the conductor is laid across the base of the recess (3) and out through a slot (4) in the first member. the second member is then pivoted back into the position shown to trap the conductor between the first and second members. When a force is applied to the conductor to tend to withdraw it from the connector, the second member (5) tends to jam the conductor between the outer surface of the second member (5) and the inner surface of the channel section (3), particularly at the bottom right hand (as seen in FIG. 1) corner plate of the second member (5).

7 Claims, 5 Drawing Sheets

ELECTRICAL CONNECTORS

This application is a continuation-in-part of application Ser. No. 444,890, filed Nov. 12, 1982 now abandoned.

This invention relates to electrical connectors, and is particularly although not exclusively concerned with domestic electrical plugs.

BACKGROUND OF INVENTION

Despite continuing development in design of domestic electrical plugs, there is not yet available a plug in which electrical connections can be made simply and safely, by the majority of users. Although the making of connections in a conventional electrical plug is not a particularly difficult job, there are still many people who find themselves unable to cope with it.

Preferred embodiments of the invention aim to provide an electrical plug which is generally improved in this respect.

It is also known to provide an electrical connector comprising first and second members which are adapted to grip an electrical conductor therebetween, and which are so arranged that, upon attempted withdrawal of the conductor by pulling on the conductor, the two members are urged together by one of the members being caused to pivot in one direction to grip the conductor more firmly between the first and second members. However, in order to release the conductor from such a connector it is necessary to pivot said one of the members in the opposite direction.

FIELD OF INVENTION

According to one aspect of the present invention an electrical connector comprises first and second members, the second member being arranged to pivot on the first member between a closed position and an open position in which, in said closed position, an electrical conductor is adapted to be gripped between the first and second members and in which, in the open position, an electrical conductor may be located in, or removed from the connector, the connector being such that when the first and second members are in the closed position and grip an electrical conductor between the first and second members and a force is exerted on the electrical conductor to tend to withdraw the conductor from the connector, that force being exerted on the electrical conductor to tend to withdraw the conductor from the connector urges the second member at least partly towards the open position, the second member being urged towards the first member to increase the grip on the electrical conductor.

According to a further aspect of the present invention an electrical connector comprises first and second members, the second member being arranged to pivotally move on the first member between an open position and a closed position in which, in said closed position, an electrical conductor is adapted to be gripped between the first and second members and in which, in said open position, an electrical conductor may be located in, or removed from the connector, the connector being such that when said first and second members are pivoted in a direction towards said closed position to grip an electrical conductor therebetween, and a force is exerted on the electrical conductor to tend to withdraw the conductor from the connector, that force being exerted on the electrical conductor to tend to withdraw it from the connector additionally biases said second member towards said first member in along an arc of said pivotal movement of said second member in moving from said closed position towards said open position thereby to increase the grip on said electrical conductor.

Preferably, the first member is electrically conductive, such that it establishes an electrical connection with an electrical conductor gripped between the first and second members, in use. The first member may advantageously comprise a pin of an electrical plug.

In an advantageous arrangement, the first member affords a recess in which the second member engages. Said recess may advantageously be of substantially U-shaped section. The pivot of the second member on the first member has a degree of play therein, such that the second member may pivot freely with respect to the first member when no conductor is gripped therebetween, but the second member makes an interference fit with the first member when a conductor is gripped therebetween.

In another aspect, the invention provides an electric plug provided with at least one electrical connector according to the first aspect of the invention.

BRIEF DESCRIPTION OF THE DRAWINGS

For a better understanding of the invention and to show how the same may be carried into effect, reference will now be made, by way of example, to the accompanying diagrammatic drawings, in which.

DESCRIPTION OF PREFERRED EMBODIMENTS

Figure 1:
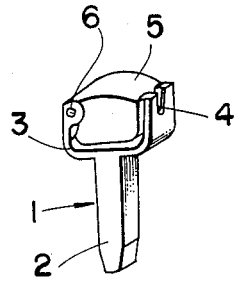
FIG. 1 shows an electrical connector embodying the invention in perspective.

The electrical connector shown in FIG. 1 is designed as a pin for a domestic electrical plug, of the square pin 13-amp type. The connector comprises a first member 1 comprising a leg 2 at the top of which there is provided a substantially U-shaped channel section 3. The channel section 3 is formed with a slot 4 to receive a flexible electrical conductor. A second member 5 is pivotally mounted at 6 on the first member 1, and is arranged to pivot into and out of the channel section 3. The second member 5 may be pivotally secured to the first member 1 by means of pivot pins or the like.

In use, the second member 5 is firstly pivoted upwardly, to leave the channel section 3 free. A conductor is then inserted through the slot 4, and laid across the base of the channel section 3. The second member 5 is then pivoted downwardly to engage in the channel section 3, and trap the wire therein. The shape of the first and second members 1 and 5 is such that, upon a force being applied to the conductor to tend to withdraw it from the connector, parts of the first and second members are urged towards one another to grip the wire more firmly therebetween. Thus, upon applying tension to the conductor away from the connector, the second member 5 tends to jam the conductor between the outer surface of the second member 5 and the inner surface of the channel section 3, particularly at the bottom right-hand (as seen in FIG. 1) corner portion 7 of the second member 5.

Figure 2:
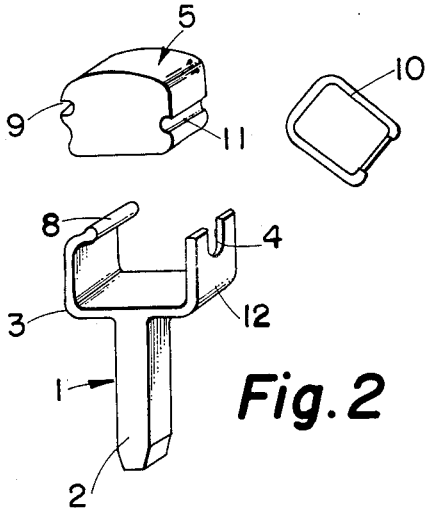
FIG. 2 is an exploded view of a variant of the electrical connector of FIG. 1.

FIG. 2 shows a modified construction of the electrical connector shown in FIG. 1. In FIG. 2, the first member 1 is provided with a leg 2 and channel section 3, as before. However, in FIG. 2, the channel section 3 is formed with a bead 8 which serves as a pivot point for the second member 5. The second member 5 is provided with a corresponding groove 9 which is adapted to engage with the bead 8. The second member 5 is retained in position on the first member 1 by means of a spring clip member 10 which engages both the first member 1 and a groove 11 in the second member 5. The arrangement illustrated in FIG. 2 has the particular advantage that both the first member 1 and the second member 5 may be extruded of brass, or other suitable material. In FIG. 2, the configurations of the bead 8 and groove 9 may advantageously be such as to provide a camming action of the second member 5 with respect to the first, during relative pivotal movement thereof. Such a camming effect serves to urge the second member 5 away from the bead 8 and towards the outer wall 12 of the channel section 3, as the second member 5 is pivoted downwardly, thereby to grip the conductor firmly between the first and second members 1 and 5.

Figure 3A:
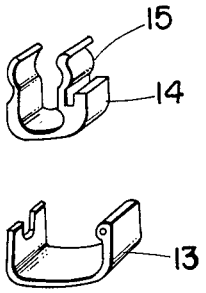
FIG. 3*a* and 3*b* show modified electrical connectors for accomodating a cartridge fuse.
Figure 3B:
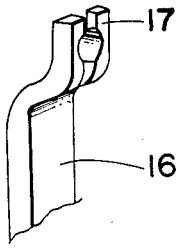

FIGS. 3*a* and 3*b* illustrated an electrical connector which employs the same principle of operation as the connector shown in FIGS. 1 and 2, but which is adapted to accommodate a cartridge fuse as in, for example, a 13-amp domestic electric plug.

In FIG. 3*a*, there is provided a first member 13 of substantially U-shaped channel section. A second member 14 is arranged to be pivotally mounted thereon, such that the arrangement of the first and second members 13 and 14 is generally similar to that of the channel section 3 and second member 5 of FIG. 1, or of FIG. 2. However, in FIG. 3*a*, the second member 14 is formed with spring jaws 15 for receiving one end of a cartridge fuse. A leg member 16, which is shown in FIG. 3, is provided also with spring jaws 17, for receiving the other end of a fuse held in the second member 14. Thus, in use, the first and second members 13 and 14 are disposed at one location in an electrical plug, and the leg member 16 at another location in the plug, with a cartridge fuse extending therebetween.

Figure 4A:
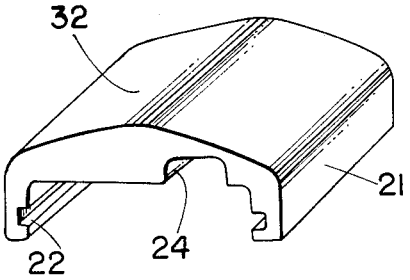
FIGS. 4*a* and 4*b* show respectively a novel cap and base of an electrical plug.

FIGS. 4*a* and 4*b* illustrate a novel housing for an electric plug, or indeed for any other electrical connector. The housing comprises a base 18, which is adapted to contain electrical connectors, and is provided with a cable aperture 19. The base 18 is provided around its periphery with a rib 20. The cap 21 of the housing is formed with an internal groove 22, which is adapted to co-operate with the rib 20 on the base 18. To secure the base and cap together, the rib 20 on the base 18 is engaged in the groove 22 on the cap 21, and the base and cap are slid relatively to one another, until they are fully closed. When the base 18 and cap 21 are fully closed, a spring-loaded detent arrangement is operative to secure the base and cap in a closed condition, until the spring detent is manually released. A projection 23 on the base 18 engages and closes a corresponding recess 24 on the cap 21, which recess 24 is provided to accommodate a cartridge fuse. As seen in FIG. 4*a*, the cap 21 is provided at its far end with an end wall which closes the housing. As seen in FIG. 4*b*, the base is provided with an end wall 25 which closes the housing.

Figure 5:
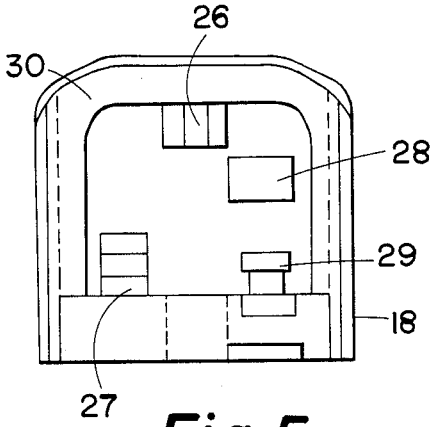
FIG. 5 shows the base in plan view.

FIG. 5 illustrates how electrical connectors 26, 27 and 28 may be disposed in the base 18, to receive earth, neutral and live conductors, respectively. The live electrical connector 28 is arranged to be joined to a live leg or pin 29 via a cartridge fuse. The electrical connectors 26, 27 and 28 are advantageously of configurations as illustrated in FIGS. 1 to 3.

In FIG. 5, there is also shown the location 30 for a spring-loaded plunger, which is urged towards a recess in the cap (at location 32 on FIG. 4*a*), to lock the base and cap together when in the fully closed condition. In this condition, the base of the plunger is advantageously in a recess on the outer face of the base 18, and level with that face. To release the locking arrangement, the plunger is depressed manually, whereupon the plunger releases the base and cap to permit relative sliding movement thereof. To this end, the plunger may, for example, be provided with a relatively enlarged portion which blocks the slideway system of the rib 20 and groove 22 when operative, and with a relatively reduced portion which frees the slideway when the plunger is depressed.

Figure 6:
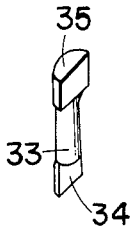
FIG. 6 illustrates a locking pin of the base and cover.

FIG. 6 shown an alternative to a spring plunger arrangement. In FIG. 6, there is provided a rotatable pin 33, having a flat tab 34 which is accessible for manipulation by a user. At its opposite end, the pin has an asymmetrical (or alternatively eccentric) head 35, which either blocks or frees the slideway in dependence upon the angular position of the pin.

Figure 7:
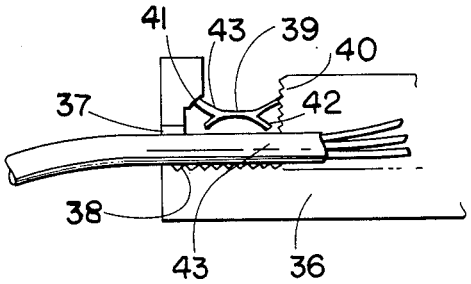
FIG. 7 illustrates a novel cable grip.

FIG. 7 shows a novel cable clamping arrangement. A base 36 of an electrical connector (such as the plug shown in FIGS. 4 and 5, for example) is provided with a cable entry aperture 37 and a serrated surface 38. A cable grip member 39, which is advantageously made of plastics material (for example, nylon), has feet 42 which engage a cable 43 resting on the serrated surface 38, and arms 43, which engage oppositely facing rows of serrations 40 and 41.

In use, the cable 43 is introduced through the aperture 37, and placed over the serrated surface 38, the various conductors 44 of the cable 43 leading to respective electrical connectors. The cable grip member 39 is then pushed downwardly towards the cable 38, until its feet 42 bear against the cable. Upon applying further pressure to the cable grip member 39 in a downward direction, the member 39 flexes, and the arms 43 engage in respective serrations 40 and 41, to lock the cable grip member 39 in position, with the cable 43 firmly clamped between the feet 42 and the serrated surface 38. It will be seen that the left-hand (as shown) series of serrations 41 are inclined such that the spacing between the serrations 41 and the serrations 40 increases towards the surface 38. This is to accommodate the arms 43 of the cable grip member 39, which arms tend to splay outwardly as the member 39 is pressed home into position.

It will be appreciated that the arrangement illustrated in FIG. 7 provides a novel and useful cable clamp, which can readily be operated without the need for any tools, and which firmly clamps a cable in position, against movement in either direction longitudinally of the cable.

Figure 4:
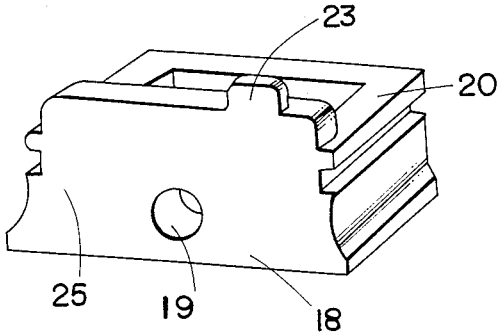
Figure 8:
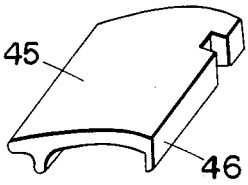
FIG. 8 illustrates a keeper plate for use in the plug.

FIG. 8 illustrates a keeper plate 45 which is advantageously used with the plug housing shown in FIGS. 4 and 5. The keeper plate 45 is formed of a flexible material, such as nylon or P.V.C., for example, and has depending ribs 46. The keeper plate 45 is arranged to be secured between the base 18 and cap 21, and the ribs 46 are of such a configuration that they bear upon the tops of the electrical connectors 26, 27, 28 and 29 within the base 18. The keeper plate 45 is made slightly over-size, such that it is compressed between the cap 21 and base 18, as they are fitted together. In this way, resilient pressure is transmitted to the electrical connectors 26 to 29, to maintain the electrical conductors therein firmly in engagement with the connectors. In this way, the flexibility of the keeper plate 45 can accommodate variations in the thicknesses of conductors retained by the respective electrical connectors.

Figure 9:
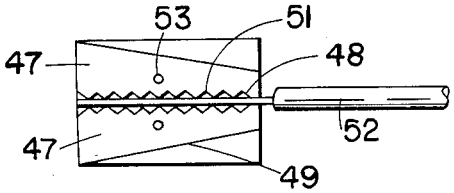
FIGS. 9*a* and 9*b* show an electrical connector for use in a plug.
Figure 9:
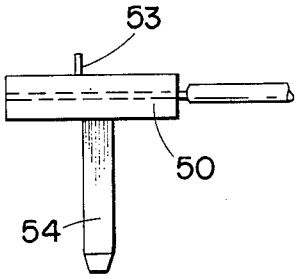

FIGS. 9*a* and 9*b* show another electrical connector to which a conductor can be secured without the use of tools. The connector comprises two tapering jaw members 47 which are provided with oppositely facing serrations 48. The jaw members 47 are mounted for sliding movement towards the left and right (as seen) in a correspondingly tapering aperture 49 in a housing 50. The jaw members 47 are resiliently biased towards the right (as seen) by spring means (not shown). In use of the connector, the jaw members are firstly urged towards the left (as seen), against their resilient bias. A conductor 51 of a cable 52 is then introduced between the serrated teeth 48 of the jaw members 47. Thereafter, the jaw members 47 are released, and are resiliently biased to the right, whereby the co-operating inclined walls urge the jaw members 47 together, to grip the conductor 51 therebetween. In the event of any force tending to withdraw the conductor 51 from between the jaws 47 (to the right, as seen), the jaw members 47 are urged more closely together, thereby to grip the conductor 51 the more firmly therebetween.

In FIGS. 9*a* and 9*b*, the jaw members 47 are provided with slots in which pins 53 engage, to hold the jaw members 47 in position. The jaw members 47 are electrically connected to a leg 54 of an electric plug connector.

Figure 10:
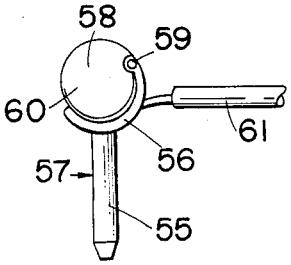
FIG. 10 shows another electrical connector.

The electrical connector shown in FIG. 10 comprises a first member 57 having a leg portion 55, at the top of which there is provided a channel section 56 of substantially part-circular internal section. A second cylindrical member 58 of circular cross-section is pivotally mounted in the channel section 56, by pivot means 59.

In use of the connector shown in FIG. 10, the second member 58 is detached from the first member 57, and a conductor 60 of a cable 61 is wrapped right around the second member 58. The second member 58 is then replaced in the first member 57, to grip the conductor 60 therebetween. Upon attempting withdrawal of the conductor 60 along the axis of the cable 61, the first and second members 57 and 58 are urged towards one another, thereby to grip the conductor 60 more firmly therebetween.

Figure 11:
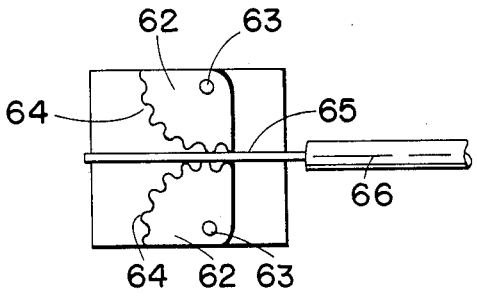
FIG. 11 shows an alternative electrical connector.

In FIG. 11, there is shown an electrical connector comprising two pivotally mounted jaw members 62, which are mounted for pivotal movement about respective pivot points 63, and are provided with respective serrated faces 64. Resilient bias means (not shown) serves to bias the top (as seen) jaw member 62 in an anticlockwise direction, and the lower jaw member 62 in a clockwise direction, about their respective pivots 63. In use, the jaw members 62 are pivoted against their resilient biases, to open a gap between the jaw members 62. Then, a conductor 65 of a cable 66 is introduced between the jaw members 62, which are then released, and the conductor 65 is gripped between the serrated surfaces 64, under the action of the resilient bias of the jaw members 62. Upon attempted withdrawal of the conductor 65 from the jaw members 62, along the axis of the cable 66, the jaws 62 pivot such that their serrated surfaces 64 are urged even further towards one another, thereby to grip the conductor 65 more firmly therebetween. Means is provided for limiting the pivotal movement of the jaw members 62, to prevent the conductor 65 being sheared thereby.

Figure 12:
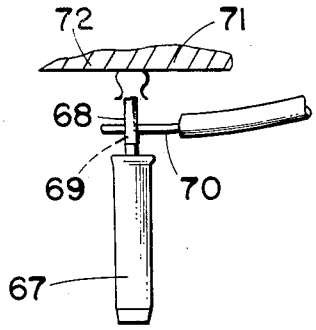
FIGS. 12 to 18 show respective electrical connectors of various configurations.

FIG. 12 shows an electrical connector in the form of a pin 67 having a projection 68 at one end thereof, and an aperture 69 in the projection 68. A conductor 70 passes through the aperture 69, and the projection 68 is then introduced into a spring clip 71, which is of such a shape that it traps the conductor 70 between the projection 78 and the walls of the clips 71, thereby to ensure good electrical contact between the conductor 70 and the pin 67. The spring clip 71 is advantageously mounted on a keeper plate 72, which is secured between a base and a cover of an electrical plug, in use. The keeper plate 72 may carry a plurality of spring clips 71, each for cooperation with a respective projection 68 on a respective pin 67, thereby to effect electrical contact between respective conductors 70 and the respective pins 67. The base and cover of the electrical plug may be secured together in any desired manner, to retain the keeper plate in position. In an advantageous arrangement, the base and cover are circular and are provided with respective screw threads, such that the base and cover may be screwed one onto the other to secure the keeper plate 72 in position. As an alternative, the spring clip 71 may be provided directly on the cover of a plug, rather than on a separate keeper plate.

Figure 13:
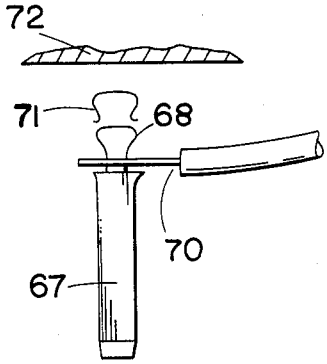

In the modification shown in FIG. 13, the projection 68 provided on the pin 67 is so formed as to correspond substantially to the contour of the spring clip 71, to provide a closer fit therebetween, and thereby facilitate gripping of the conductor 70. In FIG. 13, the spring clip is not mounted directly on the keeper plate 72. Instead, it is provided as a separate item which engages the projection 68, and the keeper plate 72 simply serves to retain the spring clip 71 in position, in use of the plug. This may be especially advantageous, as no manufacturing operation is required to secure the or each spring clip 71 to the keeper plate 72.

Figure 14:
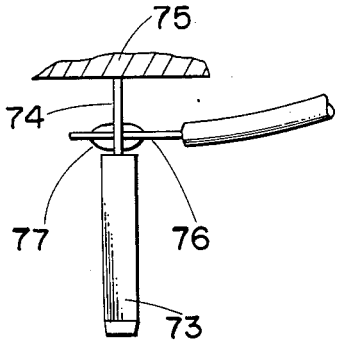

In FIG. 14, a connector pin 73 is provided with a projection 74 which engages a keeper plate 75. A conductor 76 passes through an aperture in projection 74, and is gripped in position by means of a spring clip 77 which engages the projection 74.

Figure 15:
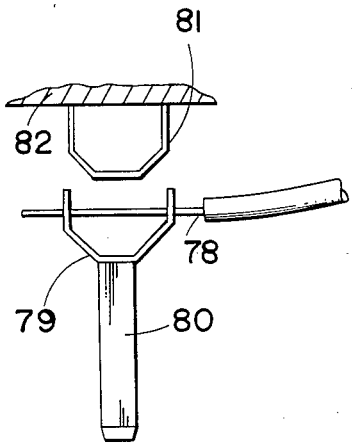

In FIG. 15, a conductor 78 passes through a pair of apertures in a channel section 79 provided at the top of a pin 80. A projection 81 carried on a keeper plate 82 resiliently engages the channel section 79, thereby to grip the conductor 78 between the mating surfaces of the projection 81 and the channel section 79.

Figure 16:
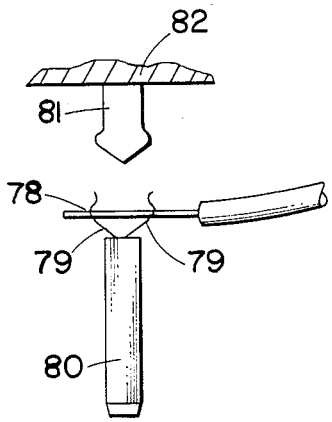

FIG. 16 shows an arrangement similar to that of FIG. 15, but in which the projection 81 and channel section 79 have mating surfaces of barb configuration, thereby more securely to interengage with one another, and grip the conductor 78 to the channel section 79.

Figure 17:
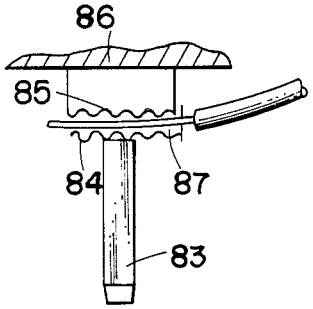

FIG. 17 shows a pin 83 provided with a serrated surface 84 at one end thereof, which is adapted to cooperate with a correspondingly shaped surface 85 provided on a keeper plate 86, thereby to grip a conductor 87 therebetween.

Figure 18:
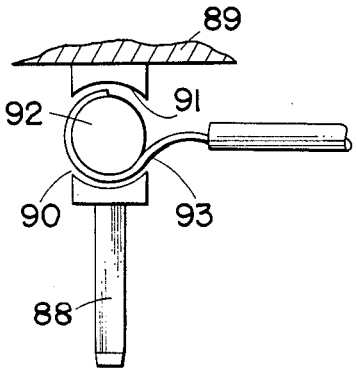

In FIG. 18, a connector pin 88 and a keeper plate 89 are provided with respective part circular cylindrical surfaces 90 and 91. A conductor 93 is wrapped right around a cylindrical member 92 which is of circular cross-section, and may be, for example, of brass. The member 92 is adapted to be clamped between the surfaces 90 and 91 on the pin 88 and keeper plate 89 respectively, thereby to grip the conductor 93 between the surfaces 90 and 91.

Figure 19:
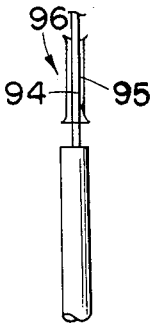
FIGS. 19*a* to 19*c* show an electrical connector utilizing spring clips.
Figure 19:
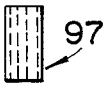
Figure 19:
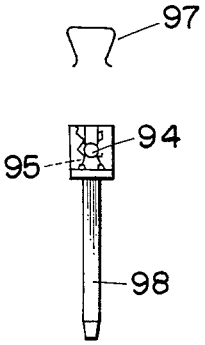

In FIGS. 19*a* to 19*c*, a conductor 94 passes through a spring clip 96, between substantially parallel walls 95 thereof. A further spring clip 97 is arranged to engage the outside of the walls 95, thereby to grip the conductor 94 firmly between the walls 95, and establish an electrical connection between the conductor 94 and a plug pin 98.

Figure 20:
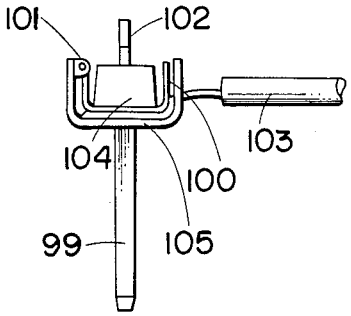
FIGS. 20*a* and 20*b* show another electrical connector.
Figure 20:
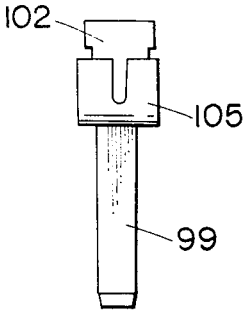

In FIGS. 20*a* and 20*b*, there is provided a first member 99, somewhat similar to the first member shown in FIG. 1. In FIGS. 20*a* and 20*b*, a clip 100 is pivotally mounted on the first member 99, at a pivot point 101. A key 102 is adapted to engage within the clip 101 and is so dimensioned that, in one position of the key 102, an enlarged portion 104 thereof bears against the clip 100, to urge the same towards the inner wall of the channel section 105 of the first member 99, thereby to grip a conductor of a cable 103 therebetween. Upon rotation of the key 102, the enlarged portion 104 thereof disengages from the clip 100, to release the clamping pressure thereon. In this way, clamping pressure upon the conductor in the connector can be applied and removed simply by turning the key 102.

Figure 21:
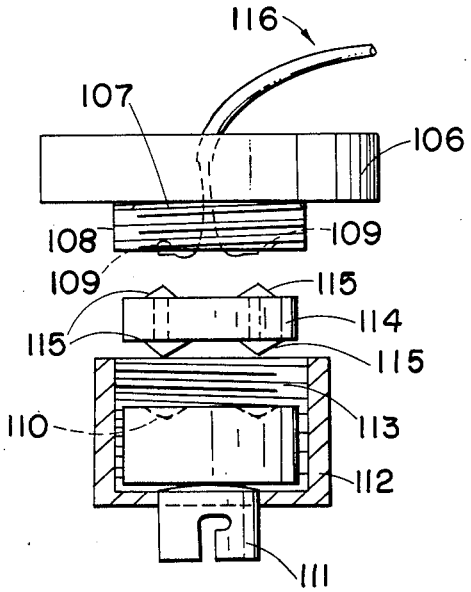
FIG. 21 illustrates an electrical connector in a batten lamp holder.

In FIG. 21, a batten lamp holder comprises a base member 106, which is adapted to be screwed to a ceiling, for example. The base member 106 is provided with a downwardly (as shown) projecting boss 107, which carries an external screw-thread 108, and is provided with conical or V-shaped recesses 109. A lamp holder element 111 is provided with similarly conical or V-shaped recesses 110. A collar 112 with an internal screw-thread 113 is mounted for free rotation about the lamp holder element 111, and an electrical connection element 114 is formed on opposite faces with projections 115 which correspond in contour to the recesses 109 and 110. Each projection 115 on one face of the element 114 is electrically connected to a projection on the opposite face. The projections 115 themselves are electrically conductive and may be, for example, of brass. In use of the arrangement shown in FIG. 21, a cable 116 is introduced through the base member 106, and conductors thereof are positioned freely in respective ones of the recesses 109. The lamp holder element 111 is then held in position with the connecting element 114 pressed between the element 111 and the base member 106, with each of the projections 115 engaging in a respective one of the recesses 109 and 110. The collar 112 then screw-threadedly engages the base member 106, by way of the screw-threads 108 and 113, and is then tightened-up until the lamp holder element 111 is held securely in position, with the connecting element 114 gripped firmly between the base member 106 and the lamp holder element 111. In this position, the two upper projections 115 (as seen in this exampe) each make electrical contact with a respective one of the cable conductors in the recesses 109, and also establish electrical contact with a respective conductive element in one of the recesses 110, via a respective one of the projections 115 on the lower face of the connecting element 114. The conductive elements in the recesses 110 lead to contact members in the lamp holder element 111, for electrical contact with an electric light bulb inserted therein.

It may thus be appreciated that, in use of the arrangement shown in FIG. 21, a safe and reliable electrical contact can be made between a cable 116 and a lamp holder 111, in a simple manner, without the need for any tools for clamping the cable conductors.

As an alternative to the arrangement in FIG. 21, the lamp holder element 111 may be provided with a more simple element which is similar in principle to the base element 106, and is arranged to receive further cable conductors each in a respective one of the recesses 110. Thus, the arrangement may function as a ceiling rose, in which a connection is safely and reliably made in a convenient manner, between the main cable 116, and a suspended flex (typically for a light), suspended from the arrangement. It may be appreciated that, in addition to establishing readily electrical connections, such an arrangement also provides a particularly safe clamping of the suspended flex.

Figure 22:
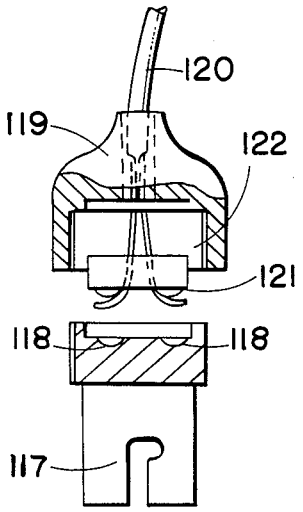
FIG. 22 illustrates an electrical connector in a suspended lamp holder.

FIG. 22 shows a suspended lamp holder which may with advantage be used with such a ceiling rose arrangement. In FIG. 22, a lamp holder element 117 has terminals (not shown) for connection to an electric light bulb, which terminals are electrically connected to conductive members within respective recesses 118. Conductors of a flex 120 pass through a cover 119, and are arranged to be gripped between projections 121 on an intermediate connecting element 122, and the recesses 118 in the lamp holder element 117. In the illustrated arrangement, the projections 121 and the recesses 118 are provided with complementary serrated surfaces.

In use of the arrangement shown in FIG. 22, the conductors of the flex 120 are gripped between the projections 121 and the recesses 118, and the cover 119 and lamp holder element 117 are screwed together until the connecting element 122 is clamped firmly therebetween, thereby securely gripping the conductors of the flex 120 between the projections 121 and the recesses 118.

Figure 23:
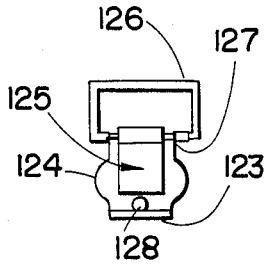
FIGS. 23*a* and 23*b*, and FIG. 24, illustrate respective electrical connectors.
Figure 23:
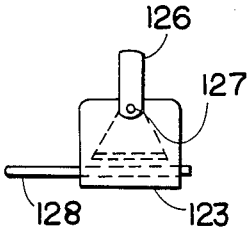

The electrical connect as shown in FIGS. 23*a* to 23*c* are particularly suitable for clamping relatively stiff conductors of higher current capacity, such as are used in electrical switch gear, for example.

In FIGS. 23*a* and 23*b*, a connector comprises an electrically conductive base member 123, with upstanding walls 124 of resilient material—for example, spring brass. A clamp 125 is mounted on an eccentric shaft 127, which is journalled at the top of the walls 124. A lever 126 is joined to the shaft 127, to effect rotation thereof.

In use, the lever is moved to rotate the shaft 127, which thereby raises the clamp 125. A relatively stiff conductor 128 is then introduced between the clamp 125 and the base 123. Thereafter, the lever 126 is moved in an opposite direction thereby to rotate the eccentric shaft 127, which causes the clamp to be urged towards the base 123, thereby to clamp the conductor 128 therebetween. The lever 126 is moved until the eccentric shaft 127 passes a centre position thereof, whereupon the connector becomes locked in the manner of an over centre or toggle mechanism. In this position, the walls 124 are somewhat deformed, thereby maintaining a clamping force between the clamp 125 and the base 123, by virtue of their resilience.

Figure 24:
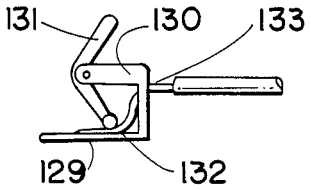

In FIG. 24, a connector comprises a generally L-shaped base member 129 of electrically conductive material, at the top of which there is provided an arm 130. A generally V-shaped lever 131 is pivotally mounted at a free end of the arm 130. At the lower end of the lever 131, there is mounted a roller 132. In use of the connector, the lever 131 is pivoted in a clockwise direction, such that the roller 132 is to the left, as seen in FIG. 24. A relatively stiff electrical conductor 133 is then introduced into the L-shaped base member, via a hole therein, and bent approximately to the configuration shown. Thereafter, the lever 131 is pivoted in an anticlockwise direction, such that the roller 132 clamps the conductor 133 against the member 129. A centre position of the lever 131 occurs when the lower arm thereof extends substantially vertically downwardly (as seen). Upon further anticlockwise movement of the lever 131, past this centre position, the roller 132 urges the conductor 133 against the upstanding portion of the base member 129. The connector is then locked in an over centre position. The base member 129, and optionally the arm 130, are of resilient material, which will flex slightly during the over centre action of the lever 131, and maintain a resilient clamping force of the roller 132 against the base member 129, with the conductor 133 therebetween.

As a variant to the arrangements illustrated in FIGS. 1 and 2, the conductor of a cable may be clamped between the first member 1 and second member 5 principally by an action of pressure imposed upon the first and second members by the base and cover of an electrical plug housing, for example. Alternatively, a keeper plate such as shown in FIG. 8, for example, may be clamped between the base and cover of a plug housing, to transmit at least a principal clamp pressure to the first and second members 1 and 5.

In FIGS. 1 and 2, the second member 5 may alternatively be of hollow, generally U-shaped section. In FIG. 2, the second member 5 may be so shaped as to snap-engage, or otherwise be retained on, a bead such as 8 on the first member 1.

As an alternative to the cable clamp of FIG. 7, a plug base such as the base 18 of FIG. **4*b*** may be provided with a screw-threaded aperture in which a screw-threaded stop engages. A cable is then clamped in the plug base by screwing down the stop onto the cable.

I claim:

1. An electrical connector comprising first and second members, the second member being arranged with a floating pivot to pivot on the first member between a closed position and an open position in which, in said closed position an electrical conductor is adapted to be gripped between the first and second members and in which, in the open position, an electrical conductor may be located in, or removed from the connector, the connector being such that when the first and second members are in the closed position and grip an electrical conductor between the first and second members and a force is exerted on the electrical conductor to tend to withdraw the conductor from the connector, that force being exerted on the electrical conductor to tend to withdraw the conductor from the connector urges the second member at least partly towards the open position and urges the second member towards the first member to increase the grip on the electrical conductor.

2. A connector according to claim 1, wherein the first member is electrically conductive.

3. A connector according to claim 2, wherein the first member affords a recess in which the second member is located in the closed position.

4. A connector according to claim 1, wherein the recess is a substantially U-shaped section.

5. A connector according to claim 4, wherein at least one of the first and second members is formed by extrusion.

6. A connector according to claim 4, wherein the second member pivots freely with respect to the first member when no conductor is gripped therebetween but the second member makes an interference fit with the first member when a conductor is gripped therebetween.

7. An electrical connector comprising first and second members, the second member being arranged to pivotally move on the first member between a closed position and an open position in which, in said closed position, an electrical conductor is adapted to be gripped between the first and second members and in which, in said open position, an electrical conductor may be located in, or removed from the connector, the connector being such that when said second member is pivoted towards said closed position to grip an electrical conductor therebetween and a force is exerted on the electrical conductor to tend to withdraw the conductor from the connector, that force being exerted on the electrical conductor to tend to withdraw it from the connector biases said second member towards said first member along an arc of said pivotal movement of said second member in moving from said closed position towards said open position thereby to increase the grip on said electrical conductor.

* * * * *